US005509618A

United States Patent [19]

Kleiman et al.

[11] Patent Number: 5,509,618

[45] Date of Patent: Apr. 23, 1996

[54] AIR SHAFT

[75] Inventors: Mark E. Kleiman, Framingham; Robert R. Bennett, Ashland, both of Mass.

[73] Assignee: Klimex, Inc., Ashland, Mass.

[21] Appl. No.: 259,622

[22] Filed: Jun. 14, 1994

[51] Int. Cl.[6] ..... B65H 75/24

[52] U.S. Cl. ..... 242/571.2

[58] Field of Search ..... 242/571.1, 571.2; 279/2.05, 2.06, 2.07, 2.08

[56] References Cited

U.S. PATENT DOCUMENTS

| | | | |
|---|---|---|---|
| 2,331,743 | 10/1943 | Sullivan . | |
| 3,108,757 | 6/1960 | Williams et al. . | |
| 3,552,672 | 1/1971 | Grettve et al. . | |
| 3,592,405 | 7/1971 | Young . | |
| 3,825,167 | 7/1974 | Komorek et al. | 279/2 |
| 3,904,143 | 9/1975 | Kullander | 242/571.2 |
| 4,026,488 | 5/1977 | Hashimoto | 242/571.2 |
| 4,114,909 | 9/1978 | Taitel et al. | 279/1 Q |
| 4,147,312 | 4/1979 | Secor et al. | 279/2.07 |
| 4,200,301 | 4/1980 | Ryan | 279/2.07 |
| 4,266,737 | 5/1981 | Mastriani . | |
| 4,467,977 | 10/1984 | Gattrugeri . | |
| 4,771,963 | 9/1993 | Gattrugeri . | |
| 5,379,964 | 1/1995 | Pretto et al. | 242/571.2 |

OTHER PUBLICATIONS

Catalog 207–Deublin Company–Deublin Expanding Air Shafts and Mechanical Shafts.

Tidland–Slitting and Winding Equipment.

Nim–Cor–Air Shafts, Bowed Rolls, Air Chucks, Roll Handling Equipment.

Goldenrod Corporation–Go For The Gold . . . Greatest Variety of Customized Roll Handling Tools in the World.

Double E Company, Inc.–Product Notes CMS–3000; Product Notes CF–1000; Product Notes DLB–2000.

*Converting Magazine,* 1990, "They're not heavy–they're lightweight carbon fiber core shafts".

Epoch Industries, Button Style Air Shaft.

*Converting Magazine,* "Composite shafts take the load off".

Daven Industries, Inc., Leaf Style Shaft and Button Style Shaft.

Emtek, The Emtek Connection.

*Paper, Film, & Foil Converter,* Jan. 1993, "Using Composites in Shafts Turning into Weighty Issue".

*Primary Examiner*—John P. Darling

*Attorney, Agent, or Firm*—Lahive & Cockfield

[57] ABSTRACT

An air shaft for gripping cores of rolls of paper and the like has an integral lightweight metal main shaft with axial grooves in its outside surface. Axial single sheet strips of expandable rubber are wedged in the grooves and air pressure is applied to one side. In the groove on the other side of the rubber sheet, are spacers and metal grippers, arranged in alternating fashion. The grippers are movable outwardly in response to the application of air pressure; the spacers are not. The spacers and grippers have coaxial through passages through which a flat steel ribbon extends. The steel ribbon biases the grippers to their retracted position and restricts the outward movement of the grippers to an appropriate range. An insert in the central portion of the air shaft reinforces it.

6 Claims, 9 Drawing Sheets

AIR SHAFT

This invention generally relates to air shafts, and more particularly, to air shafts with expandable grippers for gripping the cores of rolls of paper, film and the like.

BACKGROUND OF THE INVENTION

Paper, film and other web materials used in industry are typically supplied in large rolls wound upon cylindrical cores, usually of cardboard. When the rolls are being wound or unwound in use, the cores are usually mounted on rotatable shafts. Air chunks or air shafts are normally used to lock the core to the rotating shaft so that the rolls rotate with the rotating shaft as a unit. Air chucks are generally short. Air shafts are generally longer, and are used with wider rolls. Both are pressurized by some fluid, usually air, to expand outwardly some gripping element mounted on the air shaft to grip the core of the rolls.

Air shafts usually represent a compromise between weight, which makes the shafts unwieldy to manipulate, and strength, necessary to bear the load of large rolls of material. For example, perforations in the air shaft body through which gripping elements project have a significant negative effect on the strength and rigidity of the air shaft. If the gripping elements are instead mounted on the outside of the shaft, the complexity of the actuating systems for the gripping elements present significant engineering problems.

It is an object of this invention to provide an air shaft that will be strong and effective for gripping a roll core, and yet be light in weight, durable and simple to manufacture and operate.

SUMMARY OF THE INVENTION

The invention provides an air shaft for engaging the interior of cores of large rolls of paper, plastic and other web materials. The air shaft includes a principal, tubular, axially extending, integral metal shaft, the shall having in its outer surface, circumferentially spaced parallel, axially extending grooves. Each groove defines a narrow, axially extending, outside opening. An axially extending, elastic, single-wall sheet is located in each groove, with edges captured in a fluid tight seal in the groove. Pressure means provides fluid under pressure to one side of the sheet to expand the sheet outwardly; there are grippers located in each groove on the other side of the sheet for radial movement through the opening in response to the application of fluid pressure to the sheet, to grip the core; biasing means retract the grippers when the sheet is not under fluid pressure.

In a preferred embodiment, the grippers have axial passages through which an elongated metal strip passes to provide the biasing means to retract the grippers, the metal strip being captured within the axial passage. Also, the air shaft includes spacers, alternating with the grippers in the grooves, the spacers having retaining means for retaining the spacers in the groove. The spacers have axial passages that are coaxial with the gripper axial passages, the metal strip passing through the passages. Furthermore, the spacer axial passage and the gripper axial passage adjacent to it define a spacer surface and a gripper surface respectively that cooperate with the metal strip to limit radial movement of the gripper.

Also in the preferred embodiment, axially extending wedges are inserted between the edges of the sheet and the groove to provide the fluid tight seal, and a tubular metal insert, of a length substantially shorter than the metal shall, is inserted into the central portion of the metal shaft.

DESCRIPTION OF THE DRAWINGS

Other objects, features and advantages of the invention will be described below, or will be apparent from the following description of a preferred embodiment of the invention, including the drawing thereof, in which.

DETAILED DESCRIPTION OF A PREFERRED EMBODIMENT

Figure 1:
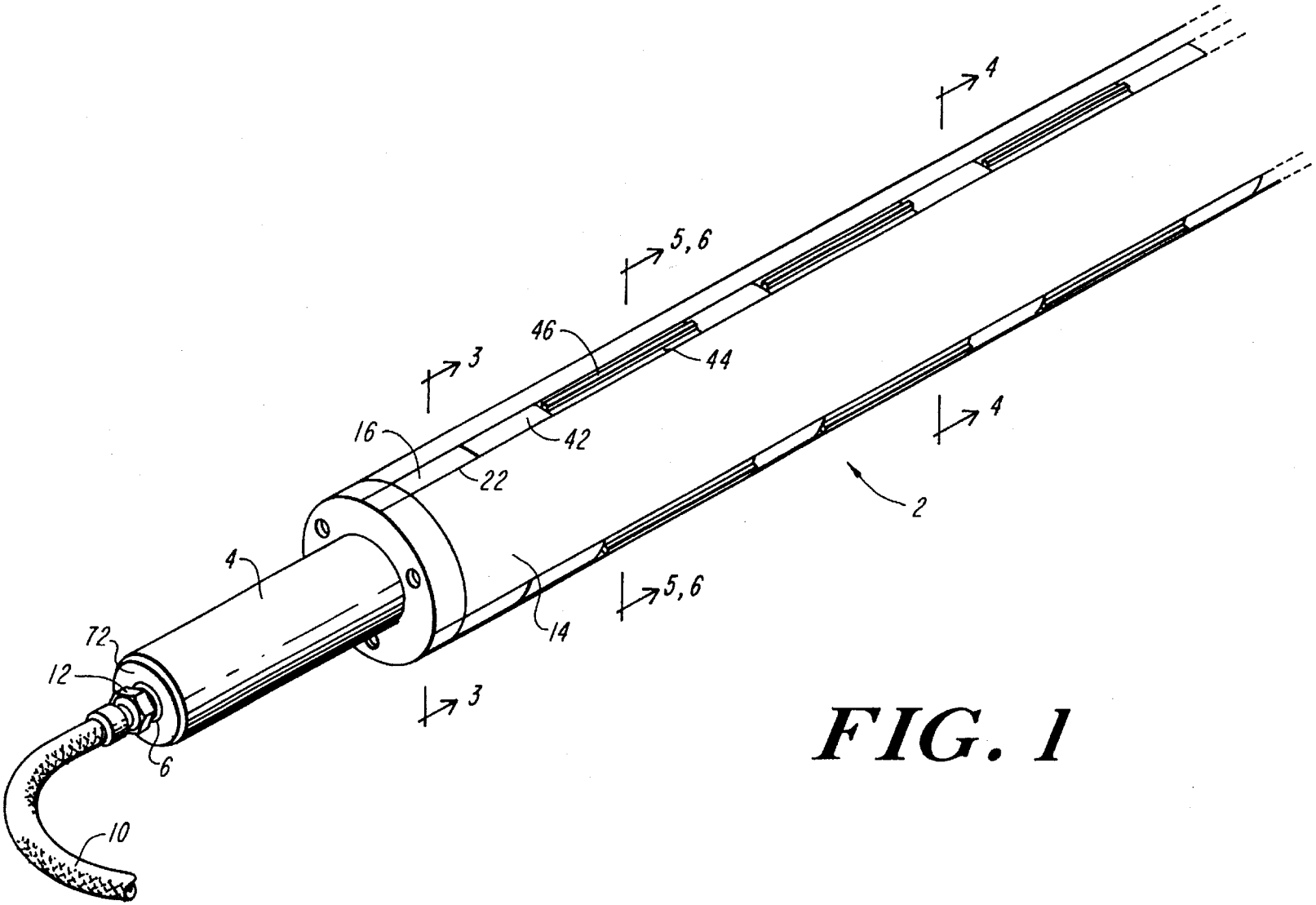
FIG. 1 is a perspective view of an air shaft embodying the invention, mounted on journals for transmitting rotation to the shall, temporarily connected to an air hose.
Figure 1A:
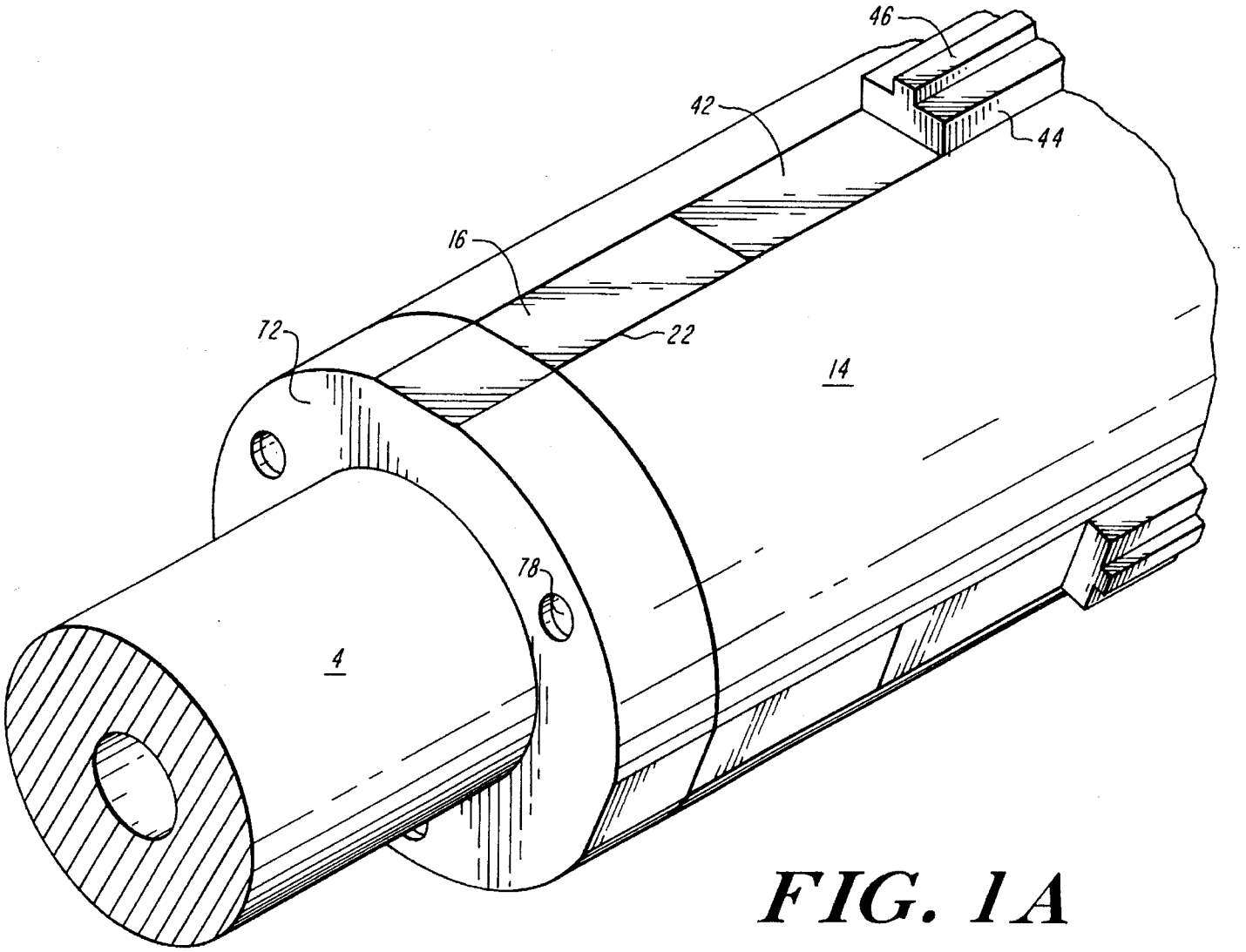
FIG. 1A is a detail of the perspective view of FIG. 1 showing the end of the shaft.

There is shown in FIG. 1 an air shaft 2 constructed according to the invention, mounted on a journal 4, the journal 4 including a valve 6 for providing fluid pressure (i.e., air pressure) to an interior passage 8 of the journal, and an air hose 10 with a fixture 12 temporarily connected to the valve 6. Only one end of the air shaft 2 is shown. Another journal (not shown) is inserted a distance into the other end of the air shaft 2.

The air shaft 2 (see FIG. 2) has a principal, tubular, axially extending extruded aluminum main shaft 14. Other lightweight metals, such as magnesium or titanium, or alloys, could be used in place of the aluminum. The main shaft 14 is integral, that is, it is a solid piece with no seams or joints providing potential failure points. In the preferred embodiment the main shaft 14 is extruded aluminum, although cast aluminum would probably be an adequate alternative. The outside dimension of the main shaft 14 is determined by the inside dimension of the roll core with which it will be used, and is typically less than 2 inches in diameter. The length of the main shaft 14 is determined by the type of machine in which the air shaft will be used. Cross sections of the main shaft 14 can be seen in FIGS. 3–6.

The main shaft 14 has formed in its outer surface three equally circumferentially spaced, parallel grooves 16. Each groove 16 extends the entire axial length of the main shaft 14. In cross-section, the groove 16 has a bottom (radially inner) wall 18, and outer wall portions 20 that define a narrow, axially extending, outside opening 22 that in this embodiment is narrower than the width of the groove 16. The groove 16 thus defines inside corners 24 beneath the outer wall portions 20.

Figure 1B:
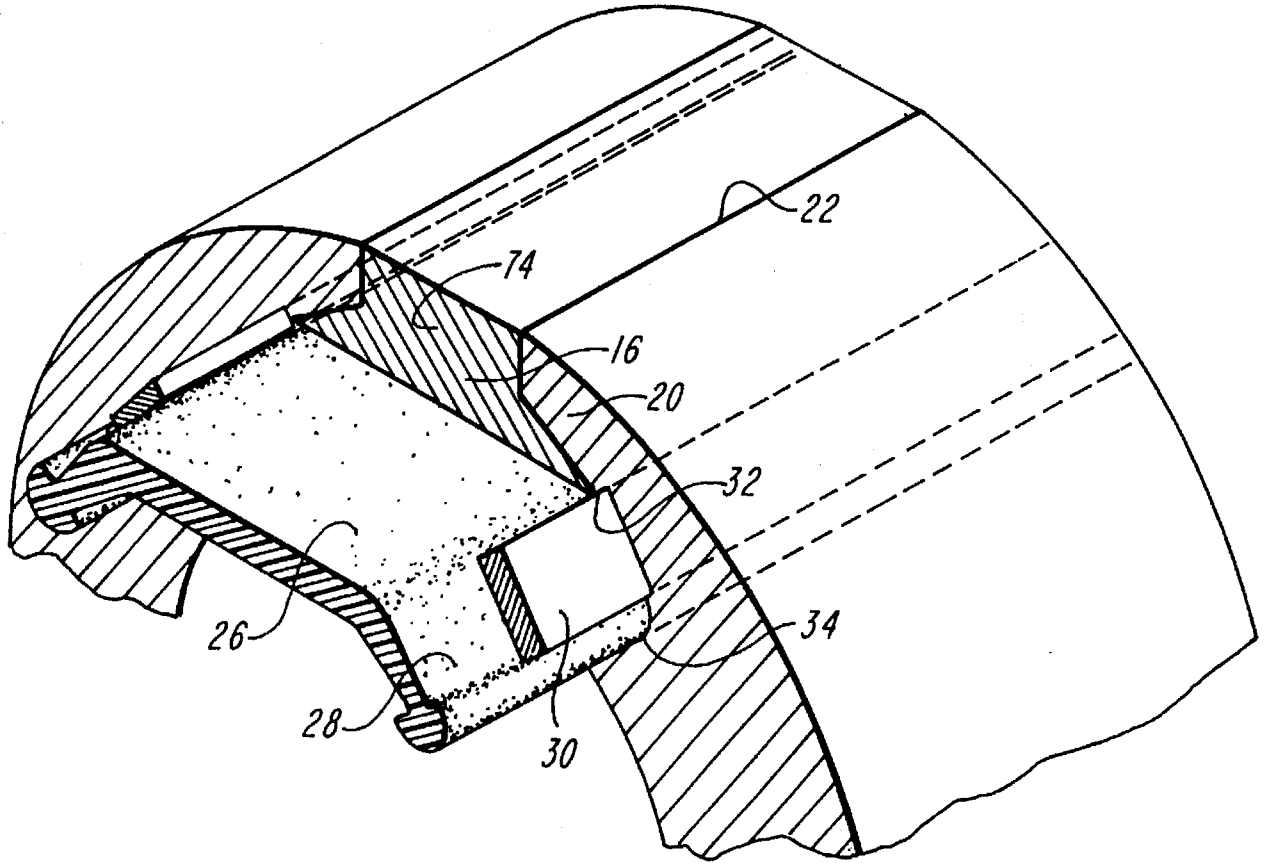
FIG. 1B is a partially cut-away detail of the perspective view of FIG. 1 showing an air shaft groove.

Located in each groove 16 is a single-wall strip of rubber sheet 26, extending axially for the entire length of the groove 16 (see FIG. 1B). The sheet 26 is compressible and elastic, and responds to the air pressure typically provided to air shafts by easily expanding outwardly. The long edges 28 of the sheet 26 are captured in a fluid tight seal in the corners 24 of the groove 16. This is accomplished by a pair of nylon strip retainers 30 having a rectangular cross section, and extending axially for the length of the groove 16. The retainer strips 30 (one on each side) are wedged into the corners 24 of the groove 16 above the rubber sheet 26. The upper walls 20 of the groove 16 have a small step 32 so that the retainers 30 can "snap" into place. The grooves 16 also have a slightly expanded portion 34 at the very end of the groove corners 24 into which the extreme outer edge 28 of the rubber sheet 26 can expand when the retainers 30 are wedged into the grooves 16. Alternatively, the rubber sheet 26 could be formed to have thicker edges, which edges would help wedge the sheet 26 into the corners 24 of the groove 16 without the necessity for retainers 30.

Figure 2:
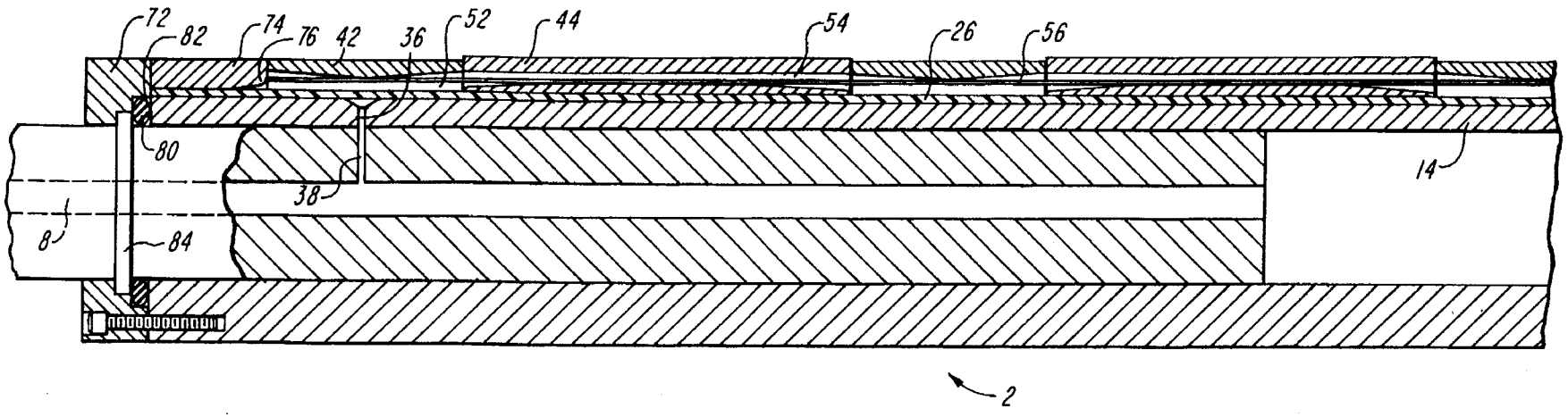
FIG. 2 is a sectional view of a portion of the air shall of FIG. 1.

As shown in FIG. 2, near one end of the main shaft 14 are three radial air passages 36 through the wall of the main shaft 14, from the interior of the main shaft 14 to each groove 16, in effect, to beneath each rubber sheet 26. These are the only perforations in the main shaft body 14. The three radial air passages 36 line up with radial passages 38 in one journal, which in turn communicate with the central air passage 8 in the journal 4 ending in the journal valve 6.

Overlaying the rubber sheet 26 in the groove 16, in alternating fashion, are metal spacers 42 and metal lugs, or grippers 44. The grippers 44 are generally rectangular in cross-section, although they have on their outer surface raised rails 46 for engaging the inside of the core on which the rolls of paper, film and the like are wound. A spacer 42 is typically an inch or two long, and a gripper 44, generally longer, is typically a few or several inches long.

Figure 5:
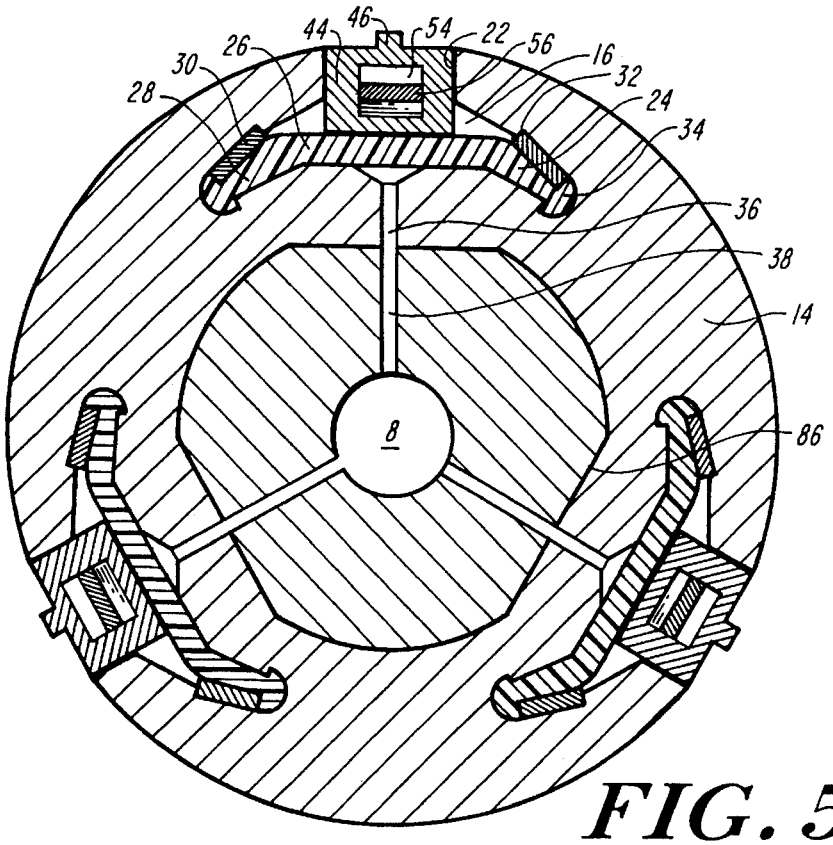
FIG. 5 is a cross-sectional view-of the air shaft taken along the line 5—5 of FIG. 1, in which the air shall grippers are in the retracted state.
Figure 6:
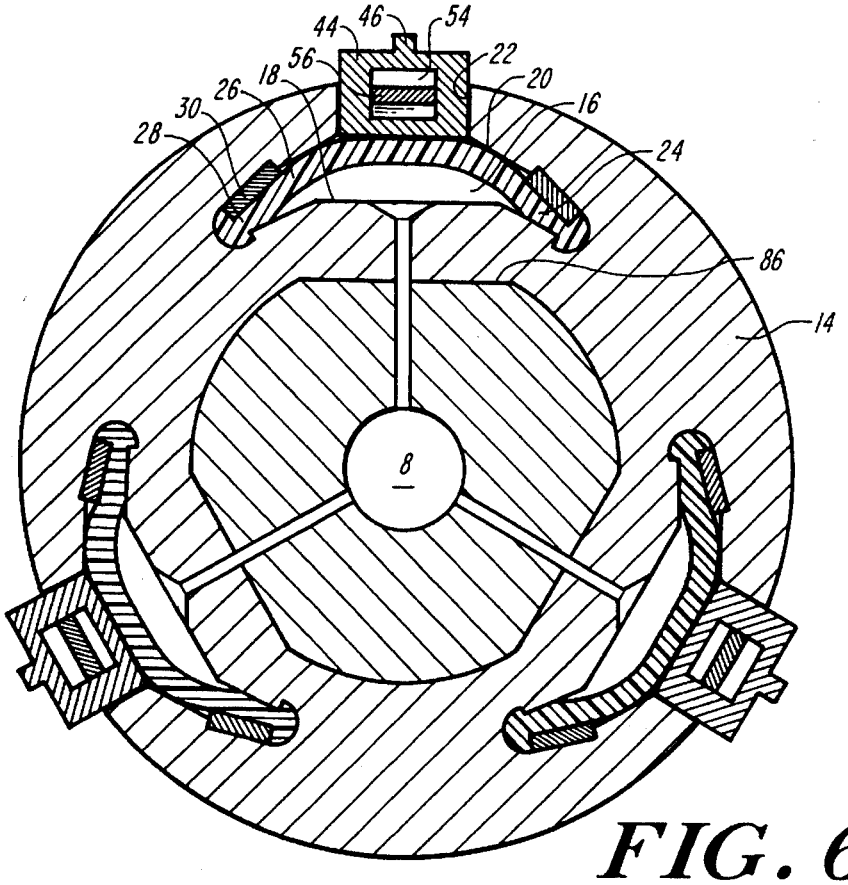
FIG. 6 is a cross-sectional view like that of FIG. 5, in which the grippers are shown in their extended state.

As shown in FIG. 5, a gripper 44 overlays the rubber sheet 26, and when no fluid pressure is being applied to the sheet 26, it is in a retracted state, with the gripper rail 46 just slightly extending above the outer circumference of the main shaft 14. When fluid pressure (i.e., air pressure) is applied to one side of the rubber sheet 26 by way of an air passage 36, the gripper 44 on the other side of the rubber sheet 26 is pushed outward through the narrow opening 22 in the groove 16 (see FIG. 6) as the rubber sheet 26 expands.

Since the gripper 44 is made of metal, the gripper rail 46 is particularly effective in engaging the core of rolls of paper and the like. Because those cores are usually made of a soft material like cardboard, the gripper rails 46 can sink into the roll and positively engage it.

Figure 4:
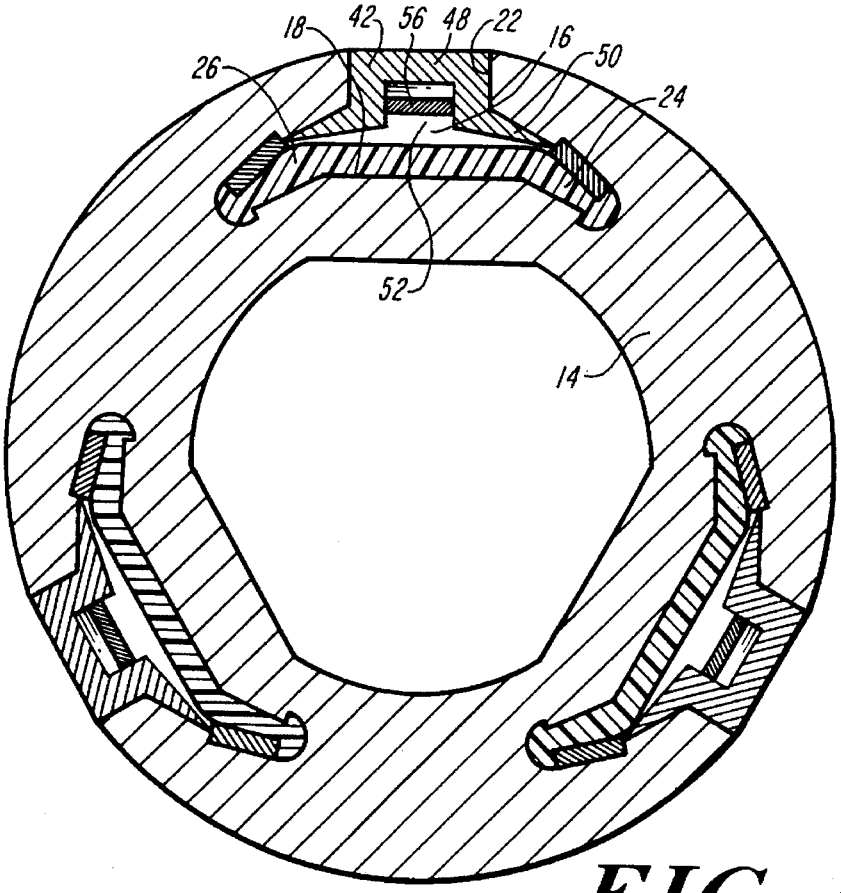
FIG. 4 is a cross-sectional view of the air shaft taken along the line 4—4 of FIG. 1.

The metal spacers 42 overlaying the rubber sheet 26 are arranged not to be movable radially out of the grooves 16. As shown in FIG. 4, a spacer 42 has a generally rectangular upper portion 48, sufficient to occupy the narrow opening 22 at the top of a shaft groove 16. Extending from the spacer 42 are lateral retaining portions 50 that serve to retain the spacer 42 in the groove 16. The spacer 42 also has enough space beneath it for the rubber sheet 26 to expand, so that it does not interfere with the passage of air beneath the rubber sheet 26.

The spacers 42 and the grippers 44 have internal axial through passages 52, 54 that are coaxially aligned. Passing through those passages 52, 54 is a ribbon 56 of spring steel, which serves to positively retract the grippers 44 when air pressure to the air shaft 2 is released, and furthermore restricts movement of the grippers 44 out of the groove 16, preventing excessive extension of the grippers 44 (see FIGS. 12A and 12B).

Figure 8:
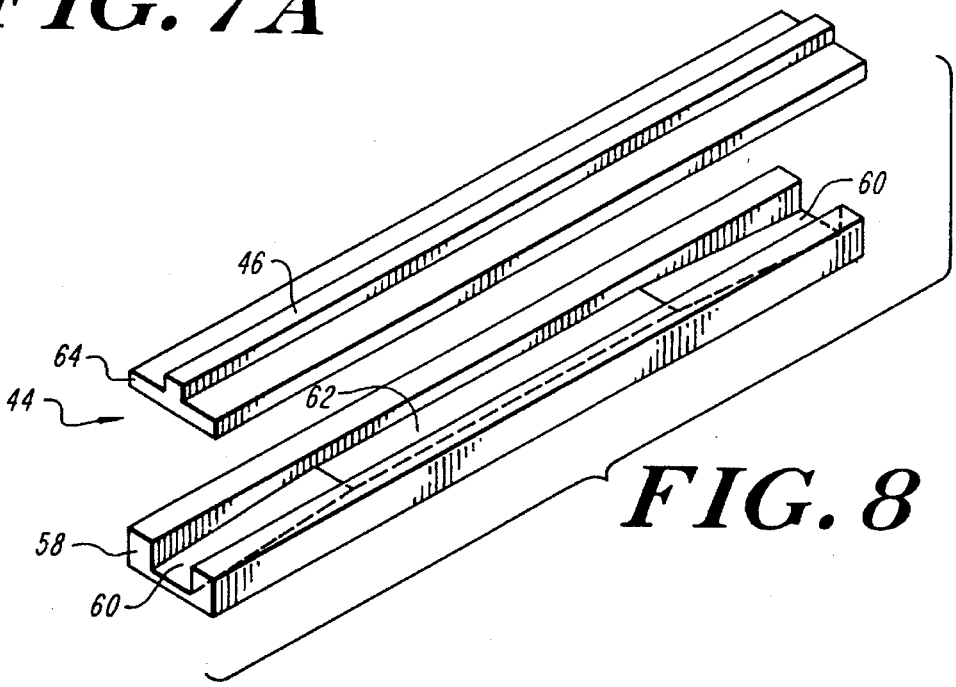
FIG. 8 is an exploded perspective view of a gripper.
Figure 9:
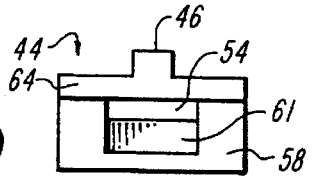
FIG. 9 is an end view of the gripper of FIG. 8.

The gripper 44 is constructed in two pieces that are then welded together (see FIG. 8). A bottom U-shaped piece 58 has ramps 60 machined on either side of its bottom surface so that a boss 61, having a raised central portion 62, is created. A flat top piece 64 (with the rail 46 above) is then welded to the bottom piece 58 to construct the gripper element 44 of the air shaft 2.

Figure 10:
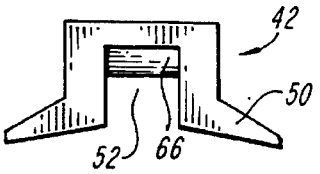
FIG. 10 is an end view of a spacer.
Figure 11:
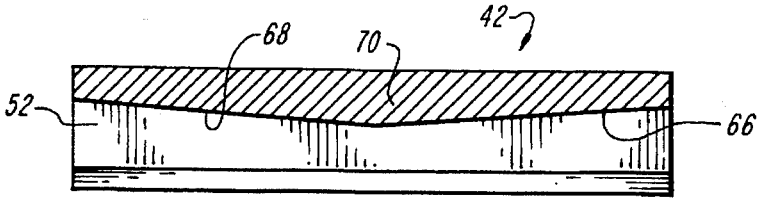
FIG. 11 is a sectional view of the spacer of FIG. 10.

The spacer 42 is extruded or cast in one piece (see FIGS. 10 and 11) and it has a surface 66 also machined to create tapered surfaces 68 extending from a central portion to form a boss 70.

Figure 12A:
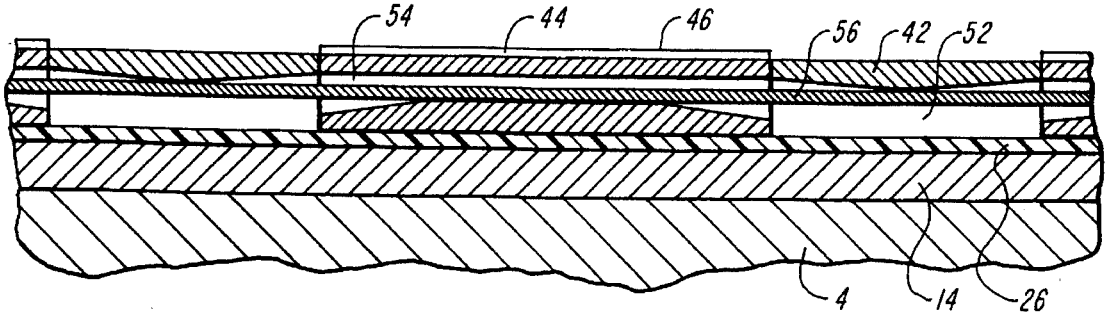
FIG. 12A is a detail sectional view of the air shaft, showing the grippers in the retracted state.
Figure 12B:
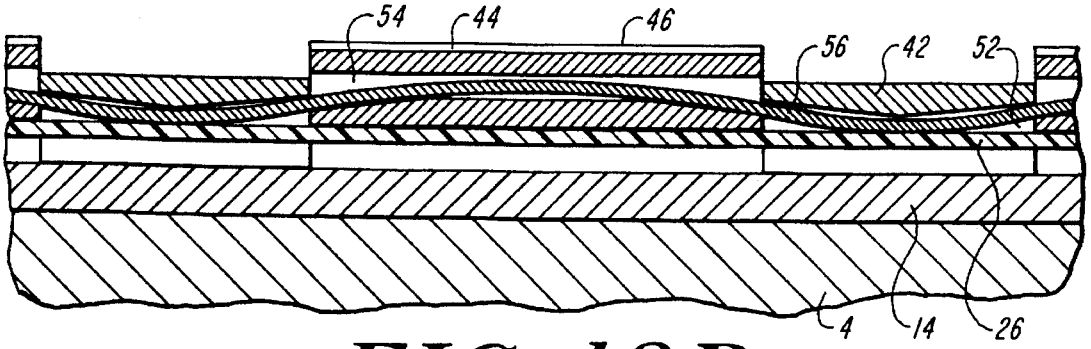
FIG. 12B is a view like FIG. 12A, showing the grippers in the extended state.

As shown in FIGS. 12A and 12B, the steel ribbon 56 passes through the aligned axial passages 52, 54, extending substantially the entire length of the groove 16, through alternating spacers 42 and grippers 44, and terminating in an end spacer 42 (see FIG. 2). When air pressure is applied to the air shaft 2, the rubber sheet 26 expands and forces a gripper 44 outward through the opening 22 of the groove 16 to grip a roll core, the steel ribbon 56 bends as a result of the movement of the grippers 44 while adjacent spacers 42 do not move. The outward movement of the grippers 44 is of course intended to be stopped under the usual circumstances by the core which the grippers 44 engage. But to be sure that the grippers 44 are not ejected from the air shaft 2, or extended beyond the mechanical limitations of the air shaft 2, the steel ribbon 56 limits the outward motion of the grippers 44 to where the steel ribbon 56 is "pinched" by adjacent spacer 42 and gripper 44.

When air pressure is released from the air shaft 2, the steel ribbon 56 restores itself to its original straight shape, and in so doing pulls, or biases, the gripper 44 to its retracted position. The grippers 44 are not physically attached to the elastic rubber sheet 26 and so do not retract automatically when the rubber sheet 26 restores itself to its original shape. Because the grippers 44 may have been embedded in the soft material of the core, a positive retracting force such as is generated by the steel ribbon 56 appears to be necessary to assure the retraction of the grippers 44.

A nylon tape (not shown) may be placed between the rubber sheet 26 and the spacers 42 and grippers 44 to protect the rubber sheet 26 against abrasion.

Figure 3:
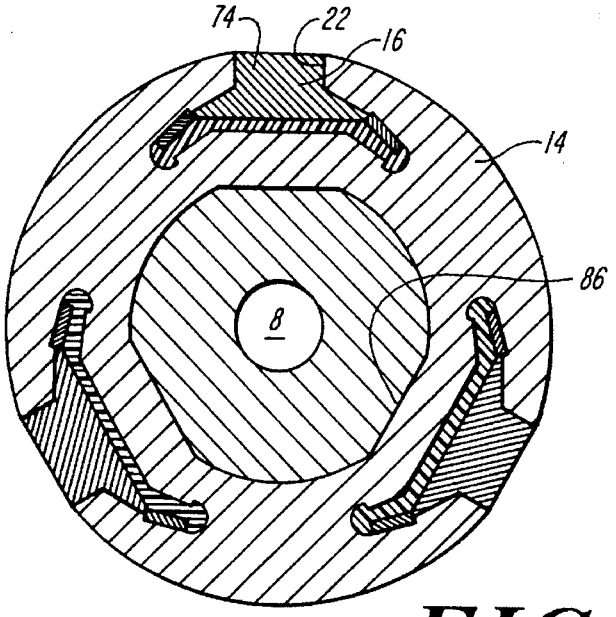
FIG. 3 is a cross-sectional view of the end of the air shaft, along the line 3—3 of FIG. 1.
Figure 7:
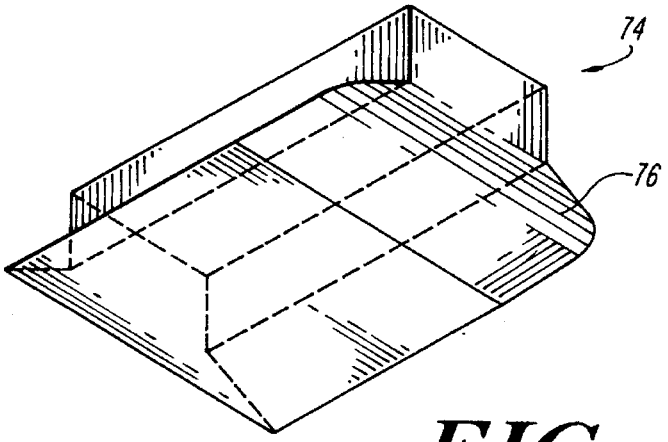
FIG. 7 is a perspective view of a wedge used to seal the end of the air shaft groove.
Figure 7A:
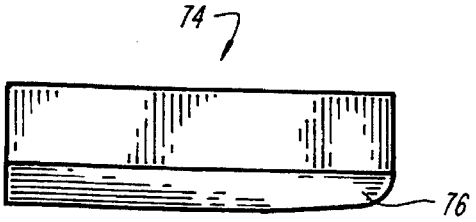
FIG. 7A is a side view of the wedge of FIG. 7.

An end cap 72 seals the ends of the main shaft 2 (see FIGS. 1B and 3). An end wedge 74 (see FIGS. 7 and 7A) is first inserted in the groove 16. It has the general cross-sectional configuration of the groove 16, and is beveled at the entry portion 76 of the wedge 74 to make insertion easier. The end cap 72 is then secured by the use of three screws 78 engaging threaded holes in the end of the main shaft 14. An O-ring 80 between an inner, inside recess 82 of the end cap 72 and the main shaft 14 maintains the fluid tight seal. The end cap 72 also captures a collar 84 of the journal 4 to secure the journal 4 to the main shaft 14. The journal 4 has three flat surfaces 86 corresponding to corresponding surfaces of the inside of the main shaft 14, so that rotary motion can be transmitted from the journals 4 to the main shaft 14.

Figure 13:
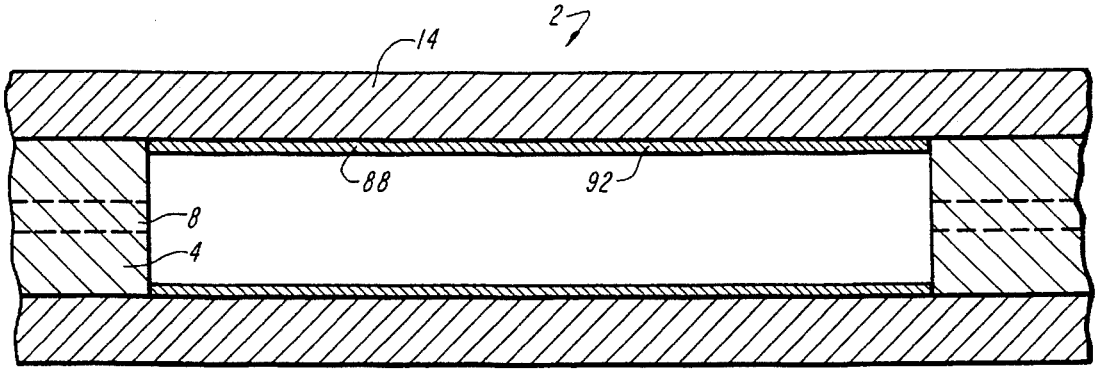
FIG. 13 is a sectional view of the central portion of the air shaft, showing a central reinforcing insert.

Finally, as shown in FIG. 13, the main shaft 14 may be reinforced by a steel or carbon fiber tubular insert 88 placed in the central portion 90 of the shaft 14. The insert 88 has an outside surface 92 similar to that of the journal 4 (that is, including three flat surfaces 86 corresponding to the inside surface of the main shaft 14), and its thickness and length is determined by the amount of reinforcement that is required by the length of the air shaft 2 and the load from the roll of paper, film and the like. Because the primary stress in the shaft 2 is at the center, the insert 88 is substantially shorter than the main shaft 14 and is still highly effective. It is feasible to add further shorter inserts inside longer inserts to carry the effect further.

In operation, the air shaft 2 is inserted into the core of a roll of paper, film and the like, and air pressure is supplied to the journal valve 6 by the removable air hose 10. The air pressure causes the rubber sheet 26 in each groove 16 to expand, lifting the grippers 44 outwardly to grip the roll core. The air hose 10 is then disconnected and removed, and power to turn the shaft 2 is applied to the journals 4 in the conventional way.

When it is desired to withdraw the air shaft 2, the air pressure is reduced, the grippers 44 are retracted by virtue of the steel spring, and the air shaft 2 is removed.

While a preferred embodiment of the invention has been described, variations and modifications of the elements described above may be generated by those skilled in the art. The invention is therefore not viewed as limited by the description of a preferred embodiment, but its scope will be determined by the following claims.

We claim:

1. An air shaft for engaging the interior of cores of large rolls of paper, plastic and other web materials, comprising a tubular axially extending, integral metal shaft, said shaft forming on its outer surface circumferentially spaced, parallel, axially extending grooves, each said groove defining a narrow, axially extending, outside opening, an axially extending, elastic, single-wall sheet strip located in each said groove, said strip having longitudinal edges captured in a fluid tight seal in said groove, pressure means for providing fluid under pressure into said groove and to one side of each said sheet strip to expand said sheet strip radially outwardly, grippers, located in each said groove on the other side of said sheet strip for radial movement through said opening in response to the application of fluid pressure to said sheet strip to grip said core, and biasing means for retracting said grippers when said sheet strip is not under fluid pressure.

2. The air shaft of claim 1, further including axially extending wedges inserted between said longitudinal edges of a said sheet strip and said groove to provide a fluid tight seal for said sheet strip.

3. An air shaft for engaging the interior of cores of large rolls of paper, plastic and other web materials, comprising a tubular axially extending, integral metal shaft, said shaft forming on its outer surface circumferentially spaced, parallel, axially extending grooves, each said groove defining a narrow, axially extending, outside opening, an axially extending, elastic, single-wall sheet located in each said groove, having edges captured in a fluid tight seal in said groove, pressure means for providing fluid under pressure to one side of each said sheet to expand said sheet radially outwardly, grippers, located in each said groove on the other side of said sheet for radial movement through said opening; in response to the application of fluid pressure to said sheet to grip said core, and biasing means for retracting said grippers when said sheet is not under fluid pressure, wherein said grippers define gripper axial passages and said biasing means comprise an elongated metal strip passing through said gripper axial passages and captured therein.

4. The air shaft of claim 3 further including spacers, each said spacer located in each said groove adjacent a gripper on the other side of said sheet, said spacer having retaining means for retaining said spacer in said groove, said spacers and said grippers alternating axially in each said groove.

5. The air shaft of claim 4 wherein said spacers define spacer axial passages coaxial with gripper axial passages of adjacent grippers, said elongated metal strip passing through said spacer axial passages and said gripper axial passages, and captured therein.

6. The air shaft of claim 5 wherein said spacer axial passage and said gripper axial passage define a spacer surface and an opposite gripper surface, respectively, selected to cooperate with each other and with said metal strip, to limit radial movement of said gripper to an amount necessary to grip said core.

* * * * *

UNITED STATES PATENT AND TRADEMARK OFFICE

CERTIFICATE OF CORRECTION

PATENT NO. : 5,509,618
DATED : April 23, 1996
INVENTOR(S) : Mark E. Kleiman and Robert R. Bennett It is certified that error appears in the above-indentified patent and that said Letters Patent is hereby corrected as shown below:

Column 1, line 13, replace "Air chuncks" with -- Air chucks --

Column 1, line 39, replace "the shall having" with -- the shaft having --

Column 1, line 40, replace "spaced parallel," with -- spaced, parallel --

Column 1, line 66, replace "the metal shall" with -- the metal shaft --

Column 2, line 9, replace "the shall, temporarily" with -- the shaft, temporarily --

Column 2, line 14, replace "the air shall of" with -- the air shaft of --

Column 2, line 21, replace "view-of" with -- view of --

Column 2, line 22, replace "the air shall grippers" with -- the air shaft grippers --

Claim 3, line 24, replace "said opening; in" with -- said opening in --

Signed and Sealed this

First Day of October, 1996

*Attest:*

*Attesting Officer*

Bruce Lehman

BRUCE LEHMAN

*Commissioner of Patents and Trademarks*